US009801427B2

(12) United States Patent
Mariacher

(10) Patent No.: US 9,801,427 B2
(45) **Date of Patent: *Oct. 31, 2017**

(54) CLIMBING SHOE

(71) Applicant: CALZATURIFICIO S.C.A.R.P.A. S.p.A., Asolo (IT)

(72) Inventor: Heinz Mariacher, Asolo (IT)

(73) Assignee: Calzaturificio S.C.A.R.P.A. S.p.A., Asolo (IT)

( * ) Notice: Subject to any disclaimer, the term of this patent is extended or adjusted under 35 U.S.C. 154(b) by 0 days.

This patent is subject to a terminal disclaimer.

(21) Appl. No.: 14/723,212

(22) Filed: May 27, 2015

(65) Prior Publication Data

US 2015/0342290 A1 Dec. 3, 2015

(30) Foreign Application Priority Data

May 29, 2014 (IT) ..... TV2014A0075

(51) Int. Cl.
*A43B 5/00* (2006.01)
*A43B 13/14* (2006.01)
(Continued)

(52) U.S. Cl.
CPC ..... *A43B 5/003* (2013.01); *A43B 13/04* (2013.01); *A43B 13/141* (2013.01); *A43B 13/16* (2013.01);
(Continued)

(58) Field of Classification Search
CPC ..... A43B 5/003; A43B 5/12; A43B 3/0063; A43B 13/141; A43B 13/16; A43B 23/0265
(Continued)

(56) References Cited

U.S. PATENT DOCUMENTS 4,716,663 A * 1/1988 Steinhauser ..... A43B 5/003 36/113
4,756,098 A 7/1988 Boggia
(Continued)

FOREIGN PATENT DOCUMENTS

EP 0933033 A2 8/1999
EP 1880622 A1 1/2008
(Continued)

OTHER PUBLICATIONS

Search Report dated Jan. 15, 2015 from Italian Patent Application No. TV20140075 filed May 29, 2014.
(Continued)

*Primary Examiner* — Sharon M Prange
(74) *Attorney, Agent, or Firm* — Sunstone IP

(57) ABSTRACT

A climbing shoe comprising a substantially sock-shaped shoe-upper, so as to completely cover the foot of the user; a front sole which is fixed on the bottom part of the shoe-upper so as to cover the tarsal-phalangeal region of the sole of the foot; a rear sole which is separate and spaced apart from the front sole and is fixed on the bottom part of the shoe-upper so as to at least partly cover the talus-calcaneus region of the sole of the foot; and a substantially ribbon-shaped medial tensioning strip which is made of elastomeric material and is fixed on the bottom part of the shoe-upper so as to extend substantially along the center line of the sole of the foot, from the shoe-upper area under the front sole up to the shoe-upper area under the rear sole following an arched trajectory.

11 Claims, 4 Drawing Sheets

(51) Int. Cl.

| | |
|---|---|
| ***A43B 13/16*** | (2006.01) |
| ***A43B 23/02*** | (2006.01) |
| ***A43B 13/42*** | (2006.01) |
| ***A43B 13/04*** | (2006.01) |
| ***A43B 13/22*** | (2006.01) |

(52) U.S. Cl.
CPC ..... *A43B 13/22* (2013.01); *A43B 13/42* (2013.01); *A43B 23/0265* (2013.01)

(58) Field of Classification Search
USPC ..... 36/91, 114, 8.3, 31, 45
See application file for complete search history.

(56) References Cited

U.S. PATENT DOCUMENTS

| | | | | |
|---|---|---|---|---|
| 7,337,558 | B2 * | 3/2008 | Terlizzi | A43B 5/12 36/102 |
| 7,673,396 | B2 * | 3/2010 | Terlizzi | A43B 5/12 36/8.3 |
| 7,895,772 | B2 * | 3/2011 | Mariacher | A43B 3/0052 36/113 |
| 8,225,534 | B2 | 7/2012 | Mueller et al. | |
| 2003/0196350 | A1 * | 10/2003 | Chu | A43B 3/06 36/58.5 |
| 2004/0111921 | A1 * | 6/2004 | Lenormand | A43B 23/047 36/45 |
| 2004/0244226 | A1 * | 12/2004 | Farys | A43B 5/003 36/140 |
| 2005/0138848 | A1 * | 6/2005 | Fullerton | A43B 13/146 36/113 |
| 2015/0257489 | A1 * | 9/2015 | Trudel | A43C 11/20 24/68 SK |

FOREIGN PATENT DOCUMENTS

| | | | |
|---|---|---|---|
| EP | 2274994 | A1 | 1/2011 |
| FR | 2619490 | A1 | 2/1989 |
| WO | 2011116423 | A1 | 9/2011 |

OTHER PUBLICATIONS

Office action dated Jun. 22, 2016 from U.S. Appl. No. 14/723,271, filed May 27, 2015.
Office action dated May 8, 2017 from U.S. Appl. No. 14/723,253, filed May 27, 2015.

* cited by examiner

CLIMBING SHOE

The present invention relates to a climbing shoe.

BACKGROUND OF THE INVENTION

As is known, climbing shoes normally consist of a leather shoe-upper which is substantially sock-shaped so as to embrace and completely cover the foot, sole of the foot included; a usually slightly spoon-shaped, semi-rigid midsole made of plastic material and which is fixed by gluing directly onto the bottom part of the shoe-upper at the tarsal-phalangeal region of the sole of the foot; of a flexible sole made of vulcanized-rubber and which is fixed by gluing onto the bottom part of the shoe-upper, over the midsole, to cover the sole of the foot; and of a series of tensioning strips made of highly-elastic rubber and which are fixed by gluing onto the shoe-upper and join/connect to the vulcanized-rubber sole so as to embrace and tighten the foot to the limit of physical pain, while however giving the shoe an increased capacity to contain the foot so as to unload the weight stress onto the toe of the foot in complete safety.

More in detail, most climbing shoes are normally provided with a front tensioning strip, traditionally called "toe-band", which is substantially U-shaped so as to cover the toe of the shoe-upper in the area surrounding the tarsal-phalangeal region of the sole of the foot, while extending/prolonging also partly on the bottom part of the shoe-upper, between the vulcanized-rubber sole and the midsole; and with a rear tensioning strip, traditionally called "side-band", which is substantially U-shaped so as to cover the shoe-upper in the area immediately over the heel of the foot (i.e. at the area of the foot where the Achilles tendon attaches to the calcaneum), and then to extend along the two lateral sides of the shoe-upper, up to reach and join the two ends of the front tensioning strip, so as to form a sort of annular-shaped elastic tie which embraces and compresses the foot with containing effect, while bending downwards the toe of the foot.

The vulcanized-rubber sole is therefore located on the bottom part of the shoe-upper so as to partly overlap the front tensioning strip and is directly glued to the front tensioning strip so as to form a kind of containing cap, which is elastically connected to the heel of the foot through the rear tensioning strip and is structured so as to compress and bend downwards the toes of the foot.

Although operating excellently, the above-described climbing shoes have highlighted a limited adaptability level to the morphology of the foot of the user, thus in some manner reducing the capacity of the climber to perceive, through the toes of the foot, the quality and conformation of the resting point.

SUMMARY OF THE INVENTION

It is therefore the aim of the present invention to make a climbing shoe which is capable of embracing the foot of the climber in a more complete and effective manner, while at the same time increasing the comfort of the footwear and the capacity to transmit features of the resting point to the climber.

In compliance with the above aims, according to the present invention there is provided a climbing shoe as defined in claim 1, and preferably, though not necessarily, in any one of the claims dependent thereon.

BRIEF DESCRIPTION OF THE DRAWINGS

The present invention will now be described with reference to the accompanying drawings, which show a non-limiting embodiment thereof, in which:

FIGS. 2, 3, 4, 5 and 6 are respective perspective views of the shoe in FIG. 1, with parts removed for clarity; whereas

DETAILED DESCRIPTION OF THE INVENTION

Figure 1:
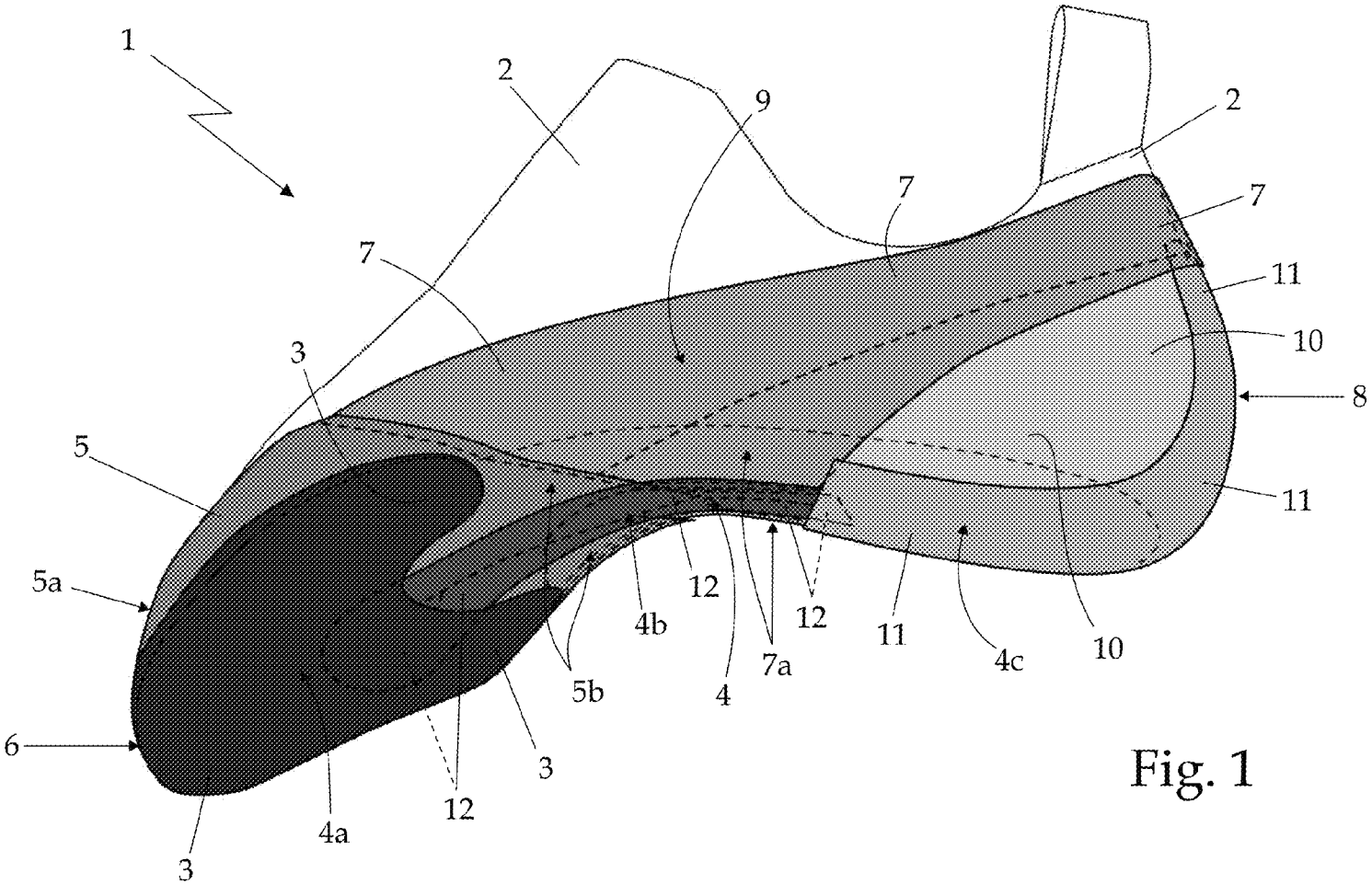
FIG. 1 is a perspective and schematic view of a climbing shoe made according to the teachings of the present invention.

With reference to figures from 1 to 7, numeral 1 indicates as a whole a climbing shoe that may be particularly advantageously used in climbing indoor climbing walls.

The climbing shoe 1 basically comprises a shoe-upper 2 which is preferably, though not necessarily, made of leather and/or other fabric or breathing synthetic material, and which is substantially sock-shaped so as to embrace and completely cover the foot of the user, sole of the foot included; and a front sole 3 made of high-grip vulcanized rubber or other similar elastomeric material (such as, for example, the compound XS Edge or the compound GRIP 2 manufactured by VIBRAM), which is fixed by gluing directly onto the bottom part 4 of shoe-upper 2 and is shaped/structured so as to cover the tarsal-phalangeal region 4*a* of the sole of the foot substantially up to the border with the insole arch region 4*b*; and a plurality of preferably pretensioned, elastic-material tensioning strips which are made of highly elastic rubber or other similar elastomeric material, and are fixed by gluing onto the shoe-upper 2 so as to embrace and tighten the shoe-upper 2 on the foot of the user.

More in detail, the climbing shoe 1 is provided with a front tensioning strip 5 and with a rear tensioning strip 7, both preferably pretensioned.

The front tensioning strip 5 is located on toe 6 of shoe-upper 2 and is substantially U-shaped so as to embrace and cover the toe 6 of shoe-upper 2 in the area surrounding the tarsal-phalangeal region 4*a* of the sole of the foot, preferably also extending/prolonging partly on the bottom part 4 of shoe-upper 2, underneath sole 3.

The rear tensioning strip 7 is instead located on the rear part 8 of shoe-upper 2 and is substantially U-shaped so as to cover the rear part 8 of shoe-upper 2 in the area immediately over the heel of the foot (i.e. in the area of the foot where the Achilles tendon attaches to the calcaneum), and then to extend/prolong along the two internal and external lateral sides 9 of shoe-upper 2 up to reach and join the front tensioning strip 5.

More in detail, the tensioning strip 7 is preferably structured so as to reach and join at the two ends of the tensioning strip 5 along the lateral sides 9 of shoe-upper 2, close to the border between the tarsal-phalangeal region 4*a* of the sole of the foot and the insole arch region 4*b*.

Figure 3:
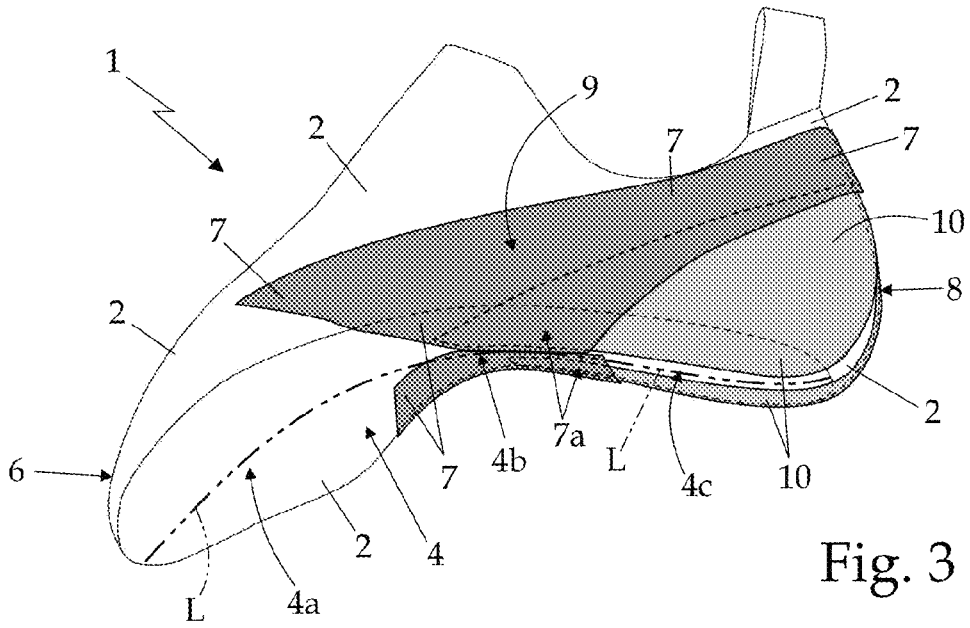

With particular reference to FIG. 3, the two ends 7*a* of tensioning strip 7 furthermore preferably also extend on the bottom part 4 of shoe-upper 2, along the insole arch region 4*b* and optionally also along the tarsal-phalangeal region 4*a* and/or the talus-calcaneus region 4*c*, to at least partly cover the insole arch region 4*b* and optionally also a small portion of the tarsal-phalangeal region 4*a* and/or of the talus-calcaneus region 4*c*.

More in detail, in the example shown, the two ends 7*a* of the rear tensioning strip 7 are preferably shaped/dimensioned so as to cover substantially the whole insole arch region 4*b* and optionally also a small part of the tarsal-phalangeal region 4*a* of the sole of the foot.

Figure 4:
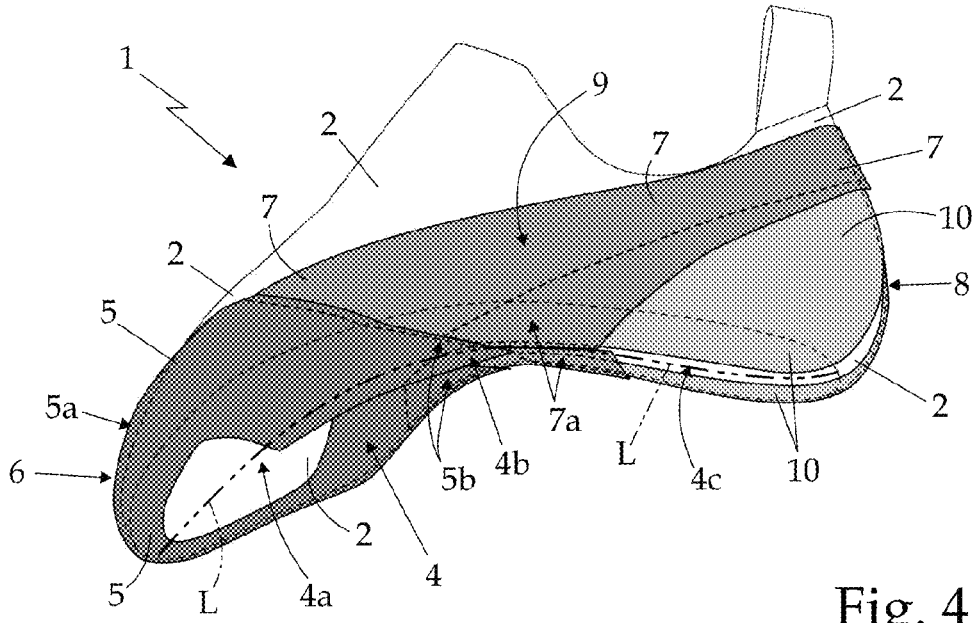

With particular reference to FIG. 4, preferably the two ends of tensioning strip 5 are instead provided with longitudinal appendages 5*b* which extend/prolong along the bottom part 4 of shoe-upper 2 so as to reach and at least partly cover the insole arch region 4*b* while also joining each other and with the two ends of the tensioning strip 7.

More in detail, the two longitudinal appendages 5*b* of tensioning strip 5 are preferably shaped/dimensioned so as to extend along the bottom part 4 of shoe-upper 2 while converging towards one another until firmly joining each other at the insole arch region 4*b*.

In the example shown, in particular, the two longitudinal appendages 5*b* of tensioning strip 5 are preferably shaped/dimensioned so as to overlap and join each other at the insole arch region 4*b*, immediately over the two ends 7*a* of tensioning strip 7.

Preferably the front tensioning strip 5 also has the middle portion 5*a* substantially cap-shaped, so as to cover both the sides and the upper part of the toe 6 of shoe-upper 2.

Figure 2:
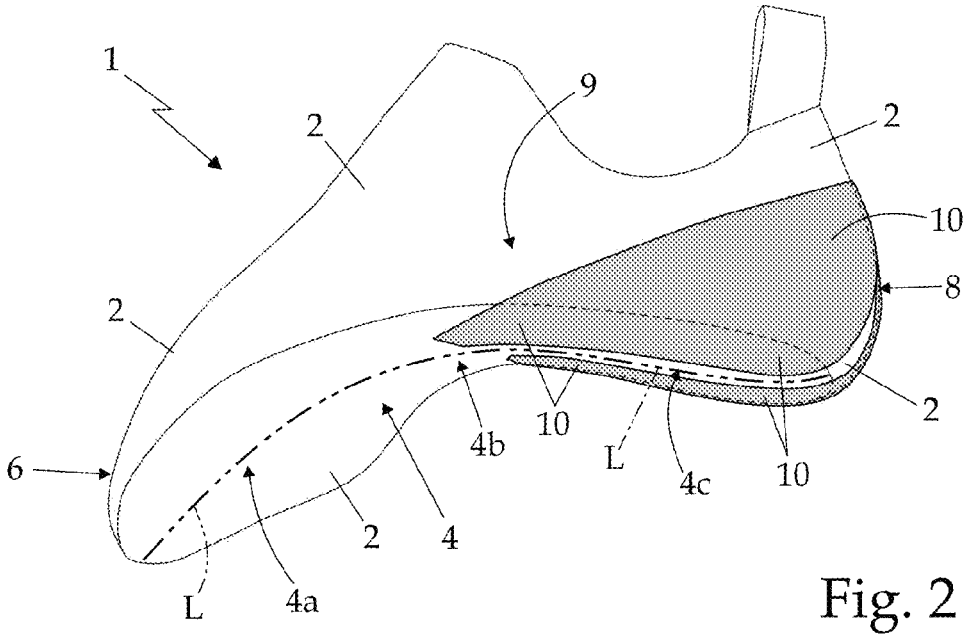

With reference to FIGS. 1, 2 and 3, preferably the climbing shoe 1 is moreover provided, on each lateral side 9 of shoe-upper 2, with a protective insert 10 made of rubber or other elastomeric material, which is fixed by gluing directly onto shoe-upper 2 and is structured so as to cover the area of shoe-upper 2 between the tensioning strip 7 and the talus-calcaneus region 4*c* of the bottom part 4 of shoe-upper 2.

Preferably protective insert 10 is moreover shaped/dimensioned so as to extend also on the bottom part 4 of shoe-upper 2, within the talus-calcaneus region 4*c* of the sole of the foot.

With particular reference to FIG. 2, in the example shown, in particular, the climbing shoe 1 is preferably provided with a single protective insert 10 made of rubber or other elastomeric material and which is shaped/dimensioned so as to cover at the same time the rear part 8 of shoe-upper 2 and the portions of the two lateral sides 9 of shoe-upper 2 that are vertically aligned with the talus-calcaneus region 4*c* of the sole of the foot, so as to protect both the lateral sides and the back of the calcaneum of the foot.

More in detail, in the example shown the protective insert 10 is preferably substantially cap-shaped and is fixed directly on shoe-upper 2 at the heel, so as to cover the lateral sides 9 and the rear part 8 of shoe-upper 2, preferably substantially up to the tensioning strip 7, and also the bottom part 4 of shoe-upper 2 within the talus-calcaneus region 4*c* of the sole of the foot.

In the example shown, in particular, the protective insert 10 is preferably shaped/dimensioned so as to cover substantially the whole talus-calcaneus region 4*c* of the bottom part 4 of shoe-upper 2, more or less up to the border with the insole arch region 4*b*.

With reference to FIGS. 1, 5, 6 and 7, the climbing shoe 1 lastly comprises: a rear sole 11 made of high-grip vulcanized rubber or other similar elastomeric material (such as, for example, the compound XS Edge or the compound GRIP 2 manufactured by VIBRAM), which is fixed by gluing directly onto the bottom part 4 of shoe-upper 2 at the talus-calcaneus region 4*c* of the sole of the foot, and is shaped/structured so as to at least partly cover the talus-calcaneus region 4*c* of the sole of the foot; and also a substantially ribbon-shaped, medial tensioning strip 12 which is made of highly elastic rubber or of other similar elastomeric material, and is fixed by gluing onto the bottom part 4 of shoe-upper 2 so as to extend substantially along the center line L of the sole of the foot, from the area of shoe-upper 2 under sole 3 up to the area of shoe-upper 2 under rear sole 11, thus following an arched trajectory substantially coincident with the center line L.

In other words, the rear sole 11 is discrete and spaced apart from the front sole 3, and the medial tensioning strip 12 is made of preferably pretensioned, elastic material, and is glued to the bottom part 4 of shoe-upper 2 underneath the front sole 3 and the rear sole 11, so as to connect the shoe-upper 2 area under the sole 3 to the shoe-upper 2 area under the rear sole 11 to counteract/limit the extension of shoe-upper 2 and thus hold the foot of the user more firmly within the footwear, with the toes of the foot pressed against the toe 6 of shoe-upper 2.

The medial tensioning strip 12 thus makes a connection between the toe and the heel of the foot.

The medial tensioning strip 12 moreover has a width which is always less than the local width of the bottom part 4 of shoe-upper 2 and extends along the bottom part 4 of shoe-upper 2, from the tarsal-phalangeal region 4*a* of the sole of the foot to the talus-calcaneus region 4*c*, passing, in the insole arch region 4*b*, over the longitudinal appendages 5*b* of front tensioning strip 5 and over the two ends of rear tensioning strip 7.

Figure 5:
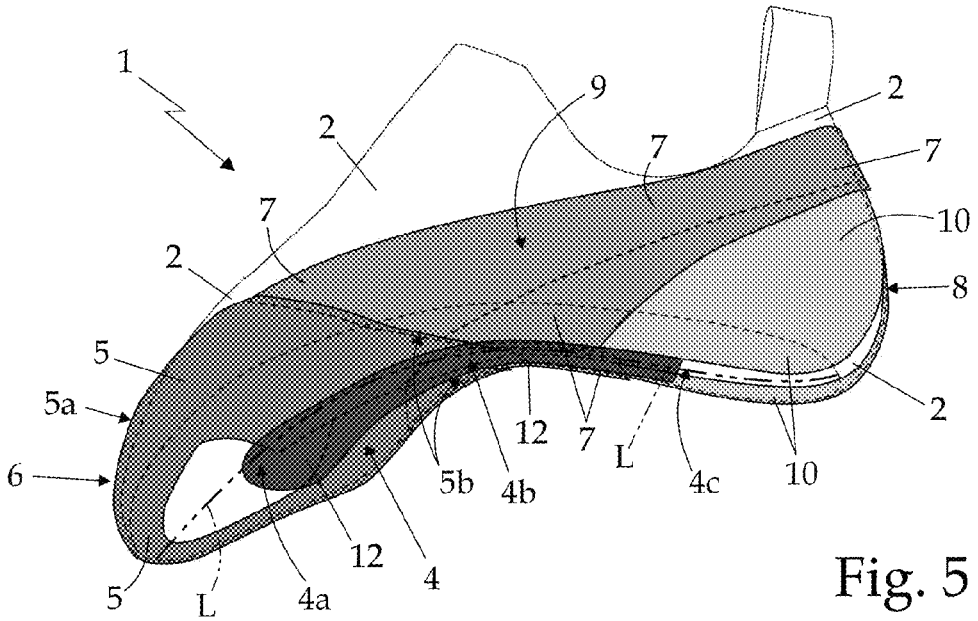

With particular reference to FIG. 5, in the example shown, furthermore, the front end of medial tensioning strip 12 is preferably glued directly onto the bottom part 4 of shoe-upper 2, substantially at the middle of the tarsal-phalangeal region 4*a* of the sole of the foot, so as to be spaced apart from tensioning strip 5.

In other words, the front end of medial tensioning strip 12 is preferably glued directly onto the bottom part 4 of shoe-upper 2, so as to be spaced apart from the front perimeter edge of the tarsal-phalangeal region 4*a* of the sole of the foot.

The rear end of medial tensioning strip 12, in turn, is preferably glued directly onto the bottom part 4 of shoe-upper 2, within the perimeter of the talus-calcaneus region 4*c*, preferably more or less at the talus.

Lastly, the middle portion of medial tensioning strip 12 is preferably directly glued onto the longitudinal appendages 5*b* of front tensioning strip 5 and onto the portions of the two ends of rear tensioning strip 7 that cover the insole arch region 4*b*.

With reference to FIGS. 1, 5, 6 and 7, preferably the rear sole 11 is furthermore shaped/structured so as to prolong/extend also slightly within the insole arch region 4*b*, so as to overlap also at the two ends 7*a* of the rear tensioning strip 7.

Furthermore, in the example shown the rear sole 11 preferably has a substantially ribbon-shaped structure and is placed and sized so as to only cover a narrow strip of the talus-calcaneus region 4*c* of the sole of the foot, which is located substantially at the center line L of the sole of the foot.

In other words, the rear sole 11 is preferably structured to cover only the middle strip of the talus-calcaneus region 4*c* of the sole of the foot, preferably by also partly overlapping the protective insert 10.

Figure 6:
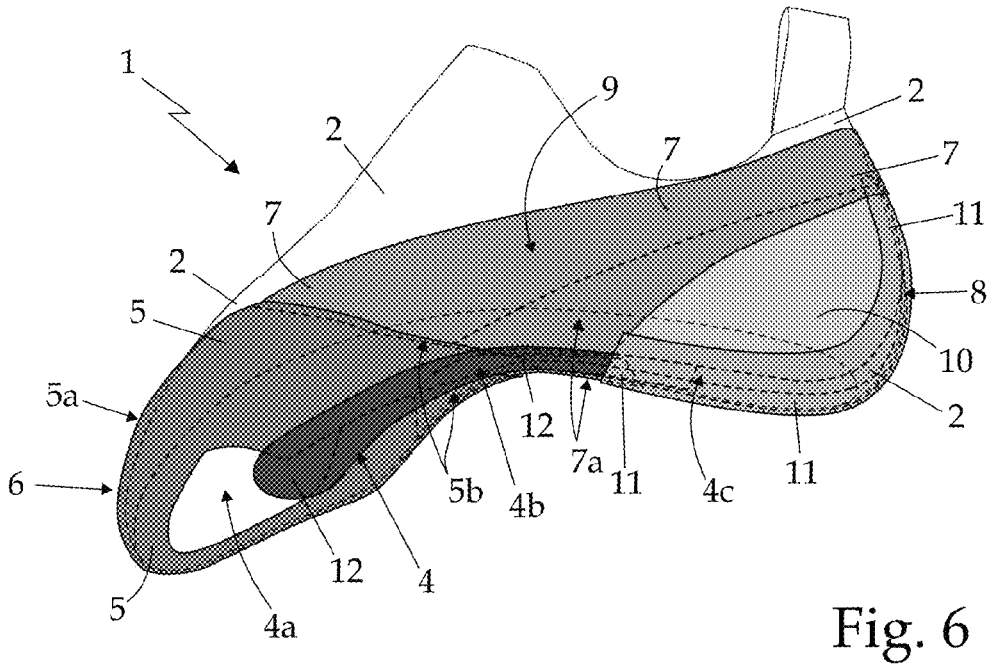
Figure 7:
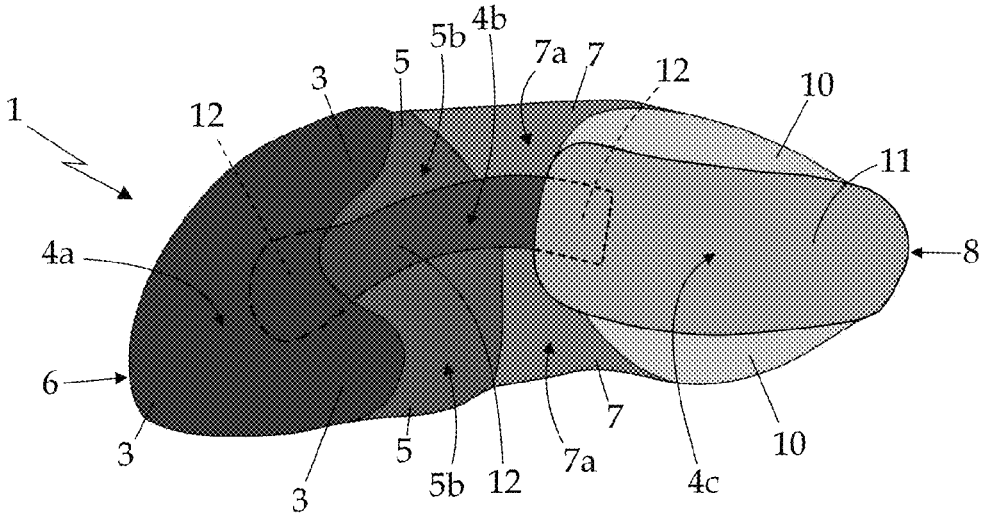
FIG. 7 is a bottom view of the shoe in FIG. 1, with parts removed for clarity.

With reference to FIGS. 1, 6 and 7, the rear sole 11 is lastly preferably shaped/structured so as to also extend along the rear part 8 of shoe-upper 2, over the protective insert 10 if present, so as to cover and protect the back of the calcaneum of the foot, preferably up to the height of the tensioning strip 7.

Operation of climbing shoe 1 is easily inferable from the above description, and therefore does not require further explanations.

The advantages resulting from the particular structure of shoe 1 are noteworthy. The medial tensioning strip 12 allows to more effectively counteract the extension of shoe-upper 2 during climbing, thus guaranteeing a more stable resting of the toe of the foot on the protrusion.

Furthermore, the removal of the semi-rigid midsole and the arrangement of the front end of medial tensioning strip 12 more or less at the middle of the tarsal-phalangeal region 4*a* of the sole of the foot, far from the end of the toes of the foot, provides the user with increased fit comfort and the capability of more precisely and accurately perceiving the morphology of the foothold on which the toe of the shoe is resting.

Last but not less important, the extension of the two tensioning strips 5 and 7 up to the insole arch region 4*b* allows to more effectively embrace the foot of the climber, thus significantly increasing the containment capacity of the footwear, with all the advantages that this involves.

Lastly, it is clear evident that modifications and variants can be made to the above-described climbing shoe 1 without departing from the scope of the present invention.

For example, the medial tensioning strip 12 may extend within the talus-calcaneus region 4*c* of the sole of the foot up to reaching the calcaneum.

The invention claimed is:

1. Climbing shoe comprising a substantially sock-shaped shoe-upper formed so as to completely cover a foot of a user; and a front sole which is fixed on the bottom part of the shoe-upper so as to cover the tarsal-phalangeal region of the sole of the foot;

the climbing shoe being characterized by also comprising a rear sole which is separate and spaced apart from the front sole, and is fixed on the bottom part of the shoe-upper so as to at least partly cover the talus-calcaneus region of the sole of the foot;

a substantially ribbon-shaped medial tensioning strip which is made of elastic material and is fixed on the bottom part of the shoe-upper so as to extend substantially along the center line of the sole of the foot, from the shoe-upper area under the front sole up to the shoe-upper area under the rear sole following an arched trajectory; and a rear tensioning strip which is made of elastic material, is fixed on the rear part of the shoe-upper, and is substantially U-shaped so as to cover the rear part of the shoe-upper in the area immediately over the heel and then extend/prolong along the two lateral sides of the shoe-upper, wherein two ends of the rear tensioning strip extend on the bottom part of the shoe-upper, along the insole arch region, so as to at least partly cover the insole arch region, and wherein the medial tensioning strip has a width which is always less than the width of the bottom part of the shoe-upper, extends along the bottom part of the shoe-upper passing over the ends of the rear tensioning strip, and is glued onto the ends of said rear tensioning strip.

2. Climbing shoe according to claim 1, characterized in that the front end of the medial tensioning strip is glued onto the bottom part of the shoe-upper, substantially adapted to be located at the middle of the tarsal-phalangeal region of the sole of the foot.

3. Climbing shoe according to claim 1, characterized in that the rear end of the medial tensioning strip is glued onto the bottom part of the shoe-upper, adapted to be within the perimeter of the talus-calcaneus region of the sole of the foot.

4. Climbing shoe according to claim 1, characterized by also comprising a front tensioning strip which is made of elastic material, is fixed on a toe of the shoe-upper, and is substantially U-shaped so as to cover the toe of the shoe-upper in the area surrounding the tarsal-phalangeal region of the sole of the foot.

5. Climbing shoe according to claim 4, characterized in that the front tensioning strip additionally extends partly over the bottom part of the shoe-upper, underneath the front sole.

6. Climbing shoe according to claim 4, characterized in that two ends of the front tensioning strip are provided with longitudinal appendages which extend/prolong along the bottom part of the shoe-upper converging towards one another to join each other at the insole arch region.

7. Climbing shoe according to claim 6, characterized in that the medial tensioning strip extends along the bottom part of the shoe-upper passing over the longitudinal appendages of the front tensioning strip and being glued onto said longitudinal appendages.

8. Climbing shoe according to, claim 6, characterized in that the longitudinal appendages of the front tensioning strip join on the ends of the rear tensioning strip at the insole arch region.

9. Climbing shoe according to claim 4, characterized in that the rear tensioning strip extends along the two lateral sides of the shoe-upper up to reach and join the two ends of the front tensioning strip.

10. Climbing shoe according to claim 4, characterized in that the front tensioning strip has a middle portion which is substantially cap-shaped, so as to cover both the sides and the upper part of the toe of the shoe-upper.

11. Climbing shoe according to claim 1, characterized in that the rear sole is shaped/structured so as to also extend on the rear part of the shoe-upper, so as to cover and protect the back of the calcaneum of the foot.

* * * * *